United States Patent [19]

Obata et al.

[11] 4,203,307

[45] May 20, 1980

[54] DETERGENT SUPPLYING DEVICE OF A WASHING MACHINE

[75] Inventors: Yukio Obata; Masayuki Fujisaki, both of Yokohama, Japan

[73] Assignee: Hitachi, Ltd., Japan

[21] Appl. No.: 37,507

[22] Filed: May 9, 1979

[30] Foreign Application Priority Data

May 10, 1978 [JP] Japan ..... 53/54520

[51] Int. Cl.[2] ..... D06F 39/02

[52] U.S. Cl. ..... 68/17 R; 137/268

[58] Field of Search ..... 68/17 R; 134/93, 100, 134/101; 137/268

[56] References Cited

U.S. PATENT DOCUMENTS 3,257,030 6/1966 Vaughn et al. ..... 68/17 R X 3,760,612 9/1973 Bochan et al. ..... 68/17 R

FOREIGN PATENT DOCUMENTS 1289412 9/1972 United Kingdom ..... 68/17 R

*Primary Examiner*—Philip R. Coe

*Attorney, Agent, or Firm*—Craig & Antonelli

[57] ABSTRACT

A detergent supplying device for supplying a detergent and a fabric conditioner into a washing basin of a washing machine. The detergent supplying device is mounted in the washing machine, and has a detergent container containing a detergent and a fabric conditioner container containing a fabric conditioner. In the preliminary washing step, the detergent supplying device delivers only water to the washing basin. In the washing step, the device delivers the detergent together with water to the washing basin. Finally, in the rinsing step, the device delivers the fabric conditioner together with the water. These three water supplying functions are performed through controls of only two water supplying solenoid valves.

5 Claims, 8 Drawing Figures

DETERGENT SUPPLYING DEVICE OF A WASHING MACHINE

BACKGROUND OF THE INVENTION

The present invention relates to a device for supplying detergent and fabric conditioner into the washing basin of a washing machine and, more particularly, to a device adapted to supply the detergent together with washing water into the washing basin in the washing step, and the fabric conditioner together with rinsing water in the rinsing step.

Such washing machines for washing clothes and the like have been known as adapted to conduct a series of works such as preliminary washing, washing, rinsing and dehydration. Automatic washing machines capable of automatically performing above stated works sequentially, through automatically controlling the supply and discharge of water into and out of the washing tank, has been known also.

A typical automatic washing machine is a drum type machine having a drum which is adapted to be rotated to impart a stirring action to the clothes and the like received therein. More specifically, this drum type washing machine has a rotary shaft rotatably disposed in the washing basin to extend substantially horizontally. A drum having a number of apertures in its wall is carried by this rotary shaft so as to be rotated at a speed of 40 to 60 r.p.m.

As the drum is rotated, th clothes or the like in the drum are lifted by a plurality of projections provided on the inner peripheral surface of the drum, and are dropped as they are lifted above the axis line of the rotary shaft, so that the clothes or the like are stirred and washed.

In this type of automatic washing machine, the washing process is so determined as to include two or more steps of washing with a detergent, so that the contamination may be completely removed even when the contamination is heavy. More specifically, the washing process usually includes the steps of (1) preliminary washing, (2) drainage, (3) water supply, (4) washing, (5) drainage, (6) water supply, (7) rinsing, (8) drainage and (9) dehydration. In some cases, the steps from the rinsing (7) to the dehydration (9) are repeated twice or more.

In the automatic washing machine adapted to perform the above stated steps sequentially, it is necessary to automatically supply a detergent into the washing basin, before the washing which is conducted subsequently to the preliminary washing. It is also necessary to automatically supply, in the final rinsing step, a fabric conditioner capable of softening the clothes and preventing electrostatic charging.

Devices adapted for automatically supplying the detergent and fabric conditioner have been proposed already and are attached in most cases to the drum type automatic washing machine. A typical device of this kind is provided with a first solenoid valve for supplying water to the washing tank in advance to the first preliminary washing step, a second solenoid valve adapted to release the detergent stored in the detergent supplying device into the washing basin together with water, and a third solenoid valve adapted to release a fabric conditioner which is stored in the device separately from the detergent into the washing basin in the final rinsing step. These solenoid valves are controlled independently or simultaneously to effect the supply of detergent, fabric conditioner and the water. Therefore, for mounting the device for supplying the detergent and fabric conditioner on the washing machine, it is necessary to install three solenoid valves, requiring a considerably large space for accommodating these solenoid valves. Also, a complicated control circuit is required for controlling the solenoid valves independently.

Since the detergent and fabric conditioner supplying device is installed in a limited space between the washing basin and a frame which constitutes the outer housing of the washing machine, it is necessary to reduce as much as possible the size of portions of the device other than the portions for storing the detergent and the fabric conditioner. In addition, since the washing machine handles water such as washing water, the electric system such as the water supply solenoid valve and associated control circuits must have a construction simplified as much as possible so as to avoid troubles attributable to the use of water.

SUMMARY OF THE INVENTION

It is therefore an object of the invention to provide an improved and economical device for supplying detergent having a reduced size and simplified construction.

It is another object of the invention to provide a device for supplying detergent capable of performing the supply of water, detergent and fabric conditioner with only two water supplying solenoid valves.

To these ends, according to the invention, there is provided a device for supplying detergent for a washing machine having a detergent container containing a predetermined amount of detergent required in the washing, and a fabric conditioner container disposed in the detergent container and containing a predetermined amount of fabric conditioner required in the rinsing. In the washing step, water is supplied to the detergent container so that the water flushes the detergent container to carry away the detergent which has been previously stored in the container so as to deliver the detergent to the washing basin. On the other hand, in the rinsing step, the water is supplied to the fabric conditioner container to flush the latter so as to carry the fabric conditioner into the washing basin. The device further has a function to supply the water solely, as in the preliminary washing step.

The device further has a crossing water passage including two water passages which cross each other substantially at a right angle to form a passage common to both water passages, the crossing water passage being provided with a first inlet port, a second inlet port, a first outlet port which opposes to the first inlet port across the common passage and a second outlet port which opposes to the second inlet port across the second water inlet port; a discharging passage for discharging the water which has been supplied to the detergent container and the fabric conditioner container and to deliver the same water to the washing basin; a water conduit having an intake port and an effluent port, the intake port being disposed on a line which passes the crossing point at which the two water passages constituting the crossing water passage cross each other, the line further passing a point intermediate between the first and the second inlet ports and a point intermediate between the first and second outlets, the intake port being opposed by the first and second inlet ports across the common passage, while the effluent port being connected to the fabric conditioner container; an inner siphon pipe disposed in the fabric conditioner container and having an inlet which extends upright from the bottom of the fabric conditioner container and an outlet connected to the discharge passage; and an outer siphon pipe surrounding the inner siphon pipe and having an opening disposed in the vicinity of the bottom of the fabric conditioner container.

In the washing step, water is supplied through a first water supplying pipe into the first inlet of the crossing passage. This water flows straight through the common passage toward the first outlet and is delivered through the latter to the detergent container. On the other hand, in the rinsing step, the water is supplied also to the second inlet via a second water supplying valve, so that the water coming from the first inlet to the common passage and the water coming from the second inlet to the common passage merge in each other, so that the flows of water are deflected and directed toward the intake port of the water conduit. As a result, the water is introduced into the fabric conditioner container, through the water conduit. As the level of the water supplied into the fabric conditioner container comes to exceed the level of the inlet of the inner siphon pipe, the inner and the outer siphon pipes come to operate as a siphon device so as to discharge the water together with the fabric conditioner. For supplying the water solely to the washing basin, the water supply to the crossing passage from the first inlet is stopped, while the water supply to the crossing passage through the second water supplying solenoid valve and through the second inlet is effected. The water supplied through the second inlet flows the common passage straight toward the second outlet and further to the discharge passage so as to be supplied into the washing basin through the discharge passage.

DESCRIPTION OF THE PREFERRED EMBODIMENTS

Figure 1:
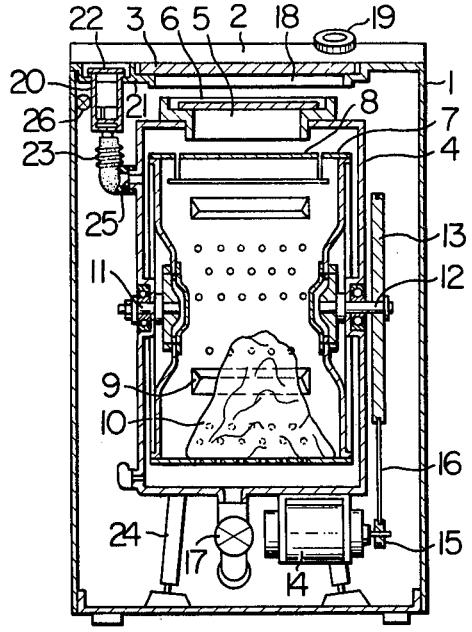
FIG. 1 is a sectional view of a washing machine incorporating a detergent supplying device of the invention.

The preferred embodiments of the invention will be fully described hereinunder with reference to the accompanying drawings. Referring first to FIG. 1, a box-shaped frame of the washing machine is provided at its upper portion with a panel section 2 accommodating control equipments which are adapted to control various operations of washing process such as washing time, water supply, drainage and so forth. A knob 19 for manipulating the controller is installed on the panel section 2. A box-shaped washing basin 4 is mounted in the frame 1 by means of a supporting device 24. An opening 18 is formed at the upper portion of the frame 1, through which the clothes or the like to be washed are put into and out of the washing basin 4. The opening 18 is adapted to be closed by a lid 3. The washing basin 4 is provided at its upper portion with an opening 5 through which the clothes or the like are put into and taken out of the washing basin 4. A lid 6 hinged to the periphery of the opening 5 is adapted to close the latter. A drum 7 is disposed in the washing basin 4. The drum 7 is provided with a large number of apertures formed in its peripheral wall and side plates. A portion of the peripheral wall of the drum 7 is cut to provide an opening through which the clothes or the like are taken into and out of the drum 7. This opening is adapted to be closed by a hinged cover 8. A plurality of projections or lifters 9 are formed on the inner peripheral surface of the drum 7. As the drum 7 is rotated, these lifters 9 lift the clothes 10 and then drops the same to impart washing and rinsing actions.

The drum 7 is fixed to rotary shafts 11, 12 which are rotatably supported by the washing basin 4, so as to be rotated in the latter together with the shafts 11, 12. A small pulley 15 is attached to the rotor shaft of a motor 14 mounted outside of the washing basin 4. The rotation of the rotor shaft of the motor 14 is transmitted to the large pulley 13 through a belt 16. A draining solenoid valve 17 disposed at the draining port of the washing basin 4 is adapted to open and close the passage of the draining port.

A detergent supplying device of the invention is generally designated at a numeral 20, and is attached to an upper panel 21 of the frame 1. The detergent supplying device 20 as a whole has a box-like form with an upper opening covered by a lid 22 which is movable between an opening position and a closing position. The device 20 is further provided at its bottom portion with a discharge passage connected through a hose 23 to a water supplying port 25 of the washing basin 4. A reference numeral 26 denotes a water supplying solenoid valve adapted to control the water supply to the detergent supplying device 20.

Figure 2:
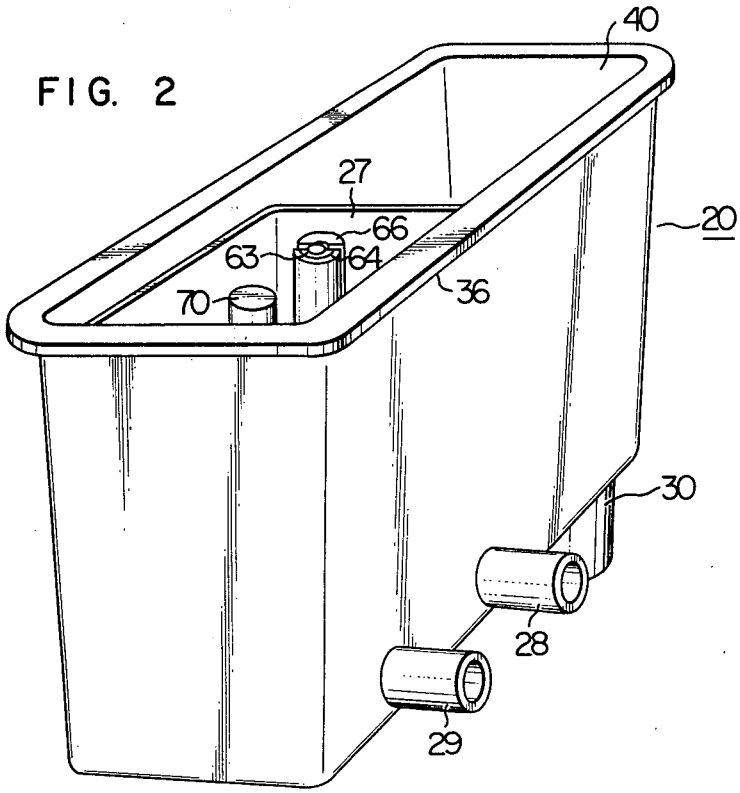
FIG. 2 is a perspective view of a detergent supplying device embodying the present invention.

As will be most clearly seen from FIG. 2, the detergent supplying device has a generally box-like form, with its upper portion opened, and receives a box-shaped fabric conditioner container 27. Further, two water supplying pipes 28, 29 project laterally from the lower portions of the side surfaces of the detergent supplying device 20.

Figure 3:
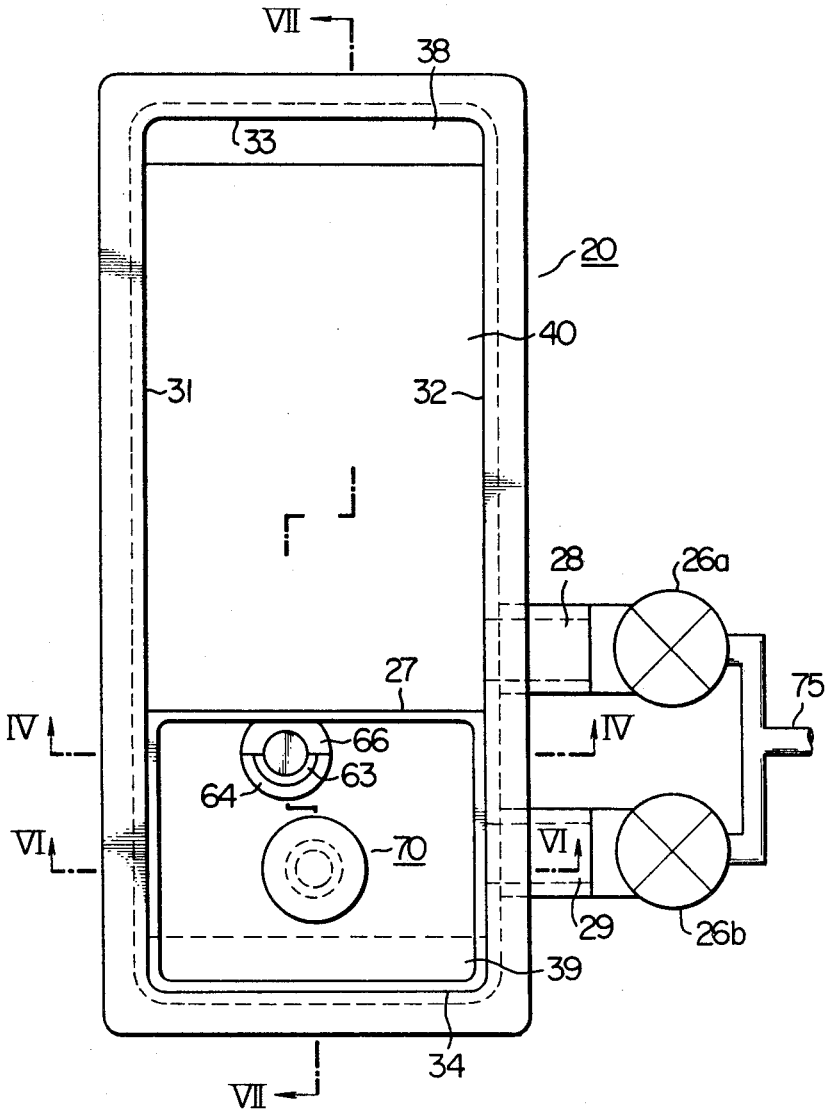
FIG. 3 is a plan view of a detergent supplying device in accordance with the invention.
Figure 4:
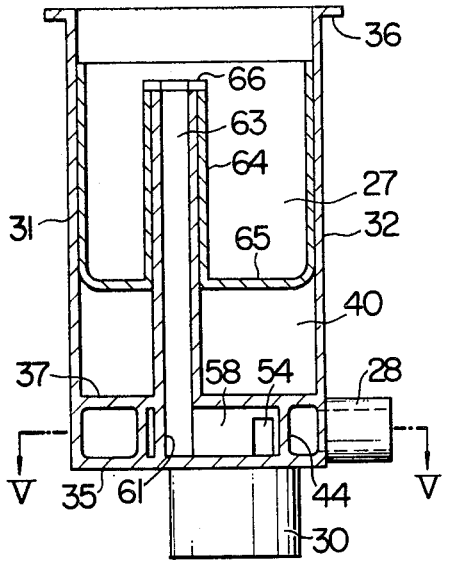
FIG. 4 is a sectional view of the detergent supplying device taken along the line IV—IV of FIG. 3.
Figure 5:
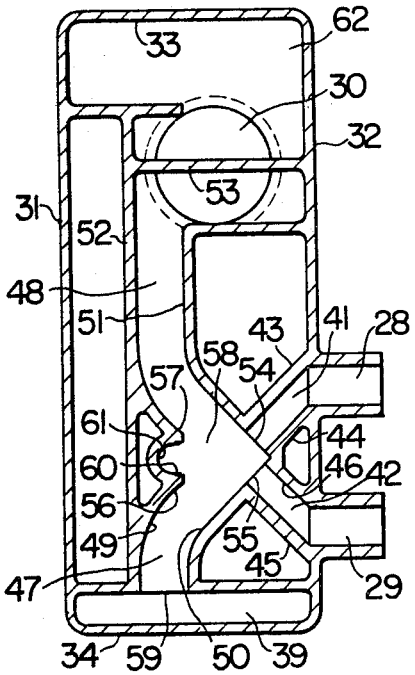
FIG. 5 is a sectional view of the detergent supplying device taken along the line V—V of FIG. 4.
Figure 6:
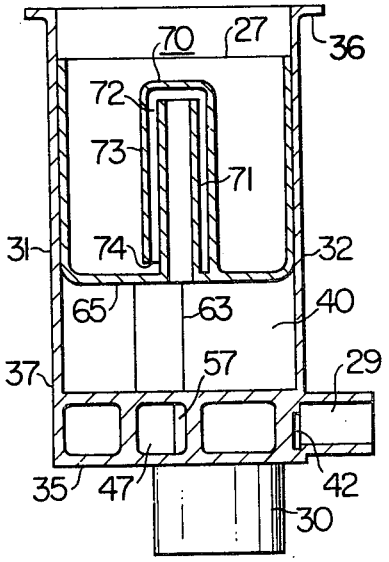
FIG. 6 is a sectional view of the detergent supplying device taken along the line VI—VI of FIG. 3.

The detail of this detergent supplying device 20 is shown at FIGS. 3 to 7. The device 20 is constituted by four side walls 31, 32, 33, 34 and a bottom plate 35. The side walls 31, 32, 33, 34 are bent at their upper ends to form a flange 36. Within the device 20, disposed is a partition plate 37 spaced from the upper surface of the bottom plate 35. The partition plate 37 is jointed to the left and right side walls 31, 32 but is not jointed to the other two side walls 33, 34 to form spaces. More specifically, the partition plate 37 and the side wall 33 cooperate with each other in defining therebetween an outlet 38 for water. Similarly, the partition plate 37 and the side wall 34 cooperate with each other in defining therebetween an inlet 39 for water. The four side walls 31, 32, 33, 34 define a detergent container 40 for storing a detergent, in cooperation with the partition plate 37. A plurality of water passages are formed between the bottom plate and the partition plate 37. These passages are shown at FIG. 5.

The first and the second water supplying pipes 28 and 29 are formed unitarily with the side wall 32 and extend outwardly from the latter. A first water passage 41 and a second water passage 42 are connected, respectively, to the first and the second water supplying passages 28 and 29. The first water passage 41 is constituted by a pair of parallel walls 43, 44 spaced from each other, while the second water passage 42 is defined by a pair of parallel walls 45, 46 spaced from each other. The first and the second water passages 41, 42 are so arranged that their outlets intersect or cross each other. To this end, the flow passages leading from the first and the second water supplying pipes 28, 29 are bent at the junctures of these pipes 28, 29 and the first and second water passages 41 and 42. A third water passage 47 is provided on the extension of the first water passage 41, while a fourth water passage 48 is provided on the extension of the second water passage 42. The third water passage 47 is defined by two walls 49, 50, while the fourth water passage 48 is defined by two walls 51, 52 and by a partition wall 53. A crossing passage 58 is formed in the area at which the four water passages cross one another, i.e. in the area surrounded by the outlet 54 of the first water passage 41, outlet 55 of the second water passage 42, the inlet 56 of the third water passage 47 and the inlet 57 of the fourth water passage 48. The outlet 59 of the third water passage 47 is connected to the inlet port 39, while the fourth water passage 48 is in communication with the discharging passage 30.

Figure 7:
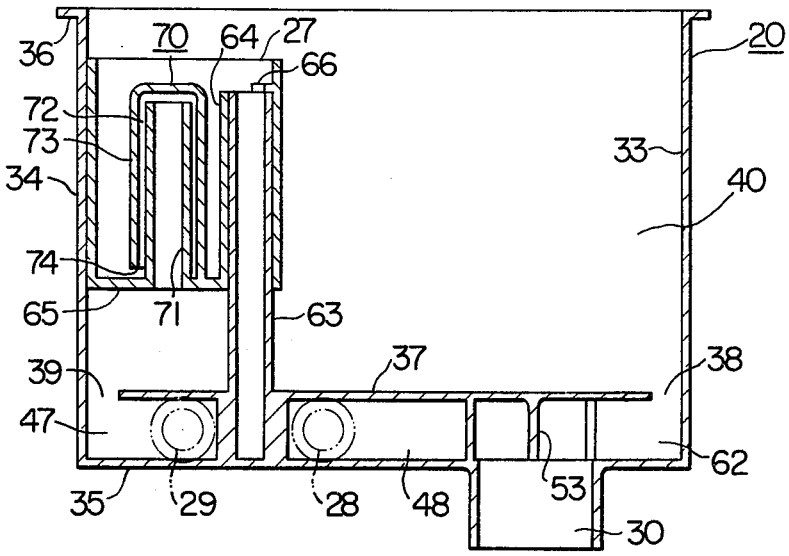
FIG. 7 is a sectional view of the detergent supplying device taken along the line VII—VII of FIG. 3.

An intake port 61 having an end 60 opened toward the crossing passage 58 is formed on an imaginary line which passes a point at which the first and the second water passages 41, 42 intersect each other and divides the first and the second passages 41, 42. A fifth water passage 62 defined by the left and right side walls 31, 32, side wall 33 and the partition wall 53 is in communication with the discharging passage 30 and further to an outlet 38 as shown in FIG. 7. As shown in FIG. 4, an upright water conduit 63 is connected to the intake port 61.

A pipe-shaped supporting member 64 having an inside diameter substantially equal to the outside diameter of the water conduit 63 extends upright from the bottom 65 of the fabric conditioner container 27, in which fitted is the water conduit 63. The container 27 is fixed to the water conduit 63 by means of the supporting member 64. The supporting member 64 is provided at its upper end with an arch-shaped projection 66 adapted to be contacted by the upper end of the water conduit 63 so as to locate the container 27. The container 27 is further provided with a siphon device 70 including an inner siphon pipe 71 extending upright from the bottom 65 of the container 27 and an outer siphon pipe 73 surrounding and covering the inner siphon pipe 71 with a space 72 left therebetween. The siphon device further has an opening 74.

As will be seen from FIG. 3, water supplying valves **26*a*, 26*b* are connected to the water supplying pipes 28, 29. Solenoid valves adapted to be electrically controlled are used as these water supplying pipes. A water supplying pipe 75 is connected to the water supplying solenoid valves 26*a*, 26*b*. The discharging passage 30 extends downward from the bottom plate 35 of the device 20, and is connected to the water supplying port 25 of the washing basin 4 through a hose 23, as shown in FIG. 1**.

The function and operation of the embodiment of the invention having the described construction will be described hereinunder.

It is assumed here that the washing process of the washing machine having the device embodying the invention is programmed to include the steps of preliminary washing, drainage, washing, rinsing (1), dehydration (1), rinsing (2), dehydration (2), rinsing (3) and dehydration (3).

Before turning to the washing, the detergent container 40 and the fabric conditioner container 27 are charged with a detergent and a liquid fabric conditioner, respectively. The washing machine is then started by a depression of the switch. For the water supply in advance to the preliminary washing, the electric power is supplied only to the second water supplying solenoid valve **26*b* to open the latter. As a result, the water supplying pipe 75 is brought into communication with the water supplying pipe 29, so that the water is introduced into the second water passage 42 and flows linearly or straight along the extension of this second water passage 42. The water then flows through the fourth water passage 48 and finally flows into the washing basin 4 of the washing machine through the discharging passage 30. In this case, therefore, the second water passage 42 and the fourth water passage 48 forms a single continuous water passage. Since the detergent required in the preliminary washing has been already supplied to the washing basin beforehand, it is not necessary to automatically supply the detergent in this preliminary washing step. For the water supply in the washing step, the electric power is supplied to the first water supplying solenoid valve 26*a* to open the latter, so that the water supplying pipe 28 is brought into communication with the water supplying pipe 75. Then, the water flows through the first water passage 41 and then along the extension of the latter. The water then flows through the third passage 47 and comes to collide with the wall 34 of the device 20. In this case, therefore, the first and the third water passages 41, 47 can be regarded as a single continuous water passage. Then, the water flushes the detergent container 40 to carry away the detergent which has been stored in the detergent container 40. The water then flows together with the detergent through the outlet 38 and then flows into the fifth water passage 62. Finally, the water flows into the washing basin 4 of the washing machine through the discharging passage 30**. The detergent is automatically supplied into the washing basin in the described manner.

For supplying the water into the washing basin in the final rinsing step of the washing process, both of the first and second water supplying solenoid valves **26*a* and 26*b* are energized. The water flows through respective valves and then through the first and the second water passages 41, 42. As a result, the flow of water through the first water passage 41 and the flow of water through the second water passage 43 cross each other at the crossing passage 58, so that the major component of the water is made to flow through the crossing passage 58 toward the intake port 61 so as to collide with the latter. A part of the water coming into collision with the intake port 61 then ascends through the water conduit 63 due to its kinetic energy or dynamic pressure and comes into the fabric conditioner container 27. As the level of the water in the fabric conditioner container is raised above the upper end of the outer siphon pipe 73, the water in the container 27 flows into the space 72** through the opening 74 of the outer siphon pipe 73, due to the action of the siphon device 70. The water then flows through the inner siphon pipe 71 and falls into the fabric conditioner container 40. The fabric conditioner in the container 27 is carried away by the water, and is delivered to the washing basin 4 of the washing machine through the same passage as the flow of the detergent. The portion of the water having passed through the first and the second passages which do not ascend through the water conduit 63 is delivered to the washing basin 4 through the third and fourth water passages 47, 48.

The flow rate of the water introduced into the fabric conditioner container 27 is determined by various factors such as the inside diameter of the water conduit 63. If the flow rate is large, the water flows into the detergent container 40 over the brim of the fabric conditioner container 27 so as to be delivered to the washing basin 4.

As the rinsing step is over, the water in the fabric conditioner container 27 is discharged through the action of the siphon device 70. In this state, only an amount of water corresponding to the level of the opening 74 is left in the container 27. Consequently, the fabric conditioner is automatically supplied to the washing basin 4.

Figure 8:
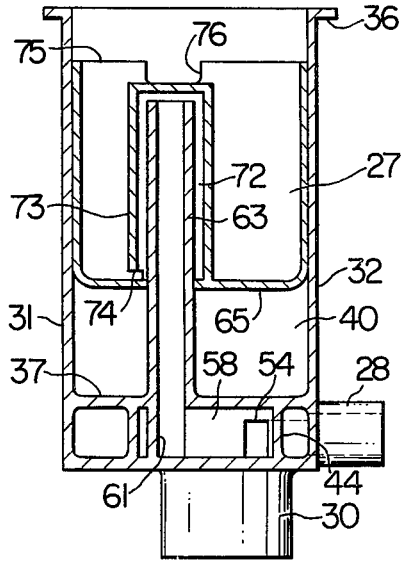
FIG. 8 is a sectional view showing a detergent supplying device which is another embodiment of the invention.

FIG. 8 shows a detergent supplying device which is another embodiment of the invention. In this embodiment, the water conduit 63 is designed and constructed to play also the role of the inner siphon pipe of the siphon device 70. The siphon outer pipe is disposed to surround the water conduit 63, defining therebetween the space 72. The opening 74 is formed in the vicinity of the bottom 65 of the container 27. The side wall 75 of the container 27 is notched at its upper end to form an outlet 76.

The bottom 65 of the fabric conditioner container 27 and the water conduit 63 are fixed to each other at their juncture in a watertight manner.

The detergent supplying device of this embodiment operate in the same manner as the first embodiment shown in FIG. 3 except the operation in the final rinsing step. Therefore, only the operation in the final rinsing step will be made, while the description of operations in other steps will be omitted.

For the water supply in the final rinsing step, both of the first and the second water supplying solenoid valves *26a, 26b* are energized. Then, water flows through both valves *26a, 26b*. The flows of water through the first and second water passages 41, 42 cross each other, and the major part of the resulting water flows straight through the crossing passage 58 and comes to collide with the intake port 61. A part of this flow of water then ascends through the water conduit 63 and comes into the fabric conditioner container 27 through the space 72 between the outer siphon pipe 73 and the water conduit 63.

As the water level in the fabric conditioner container 27 rises above the upper end of the outer siphon pipe 73, the mixture of water and the fabric conditioner flows out through the outlet 76 and falls into the detergent container 40. The mixture is then delivered to the washing basin 4 through the same passage as the flow of the detergent. The water which does not ascend through the water conduit 63 is supplied to the washing basin through the third and fourth water passages 47, 48. As the supply of water is over, the water in the fabric conditioner container 27 is introduced to the water conduit 63 through the opening 74 and the space 72, by the siphon action of the siphon device 70. Then, the water is discharged through the fourth passage 48 and then the discharging passage 30. When the water supply in the final rinsing step is over, the water in the fabric conditioner container 27 is discharged through the siphon action, leaving only an amount of water corresponding to the level of the opening 74. The fabric conditioner is thus automatically supplied to the washing basin of the washing machine.

As has been described, in the detergent supplying device of the invention used in combination with a full automatic washing machine having the step of preliminary washing, the supply of the water, detergent and fabric conditioner is automatically controlled such that water is supplied solely in the preliminary washing step, water and detergent are supplied in the washing step, and water and fabric conditioner are supplied in the final rinsing step. It is also remarkable that these three functions are performed only by two water supplying solenoid valves. In addition, since this device does not incorporate any valve or deflector for changing the direction of flow of water, it is entirely free from various troubles such as malfunctioning due to freezing in the winter season.

Further, since these three functions are performed only by two solenoid valves, the cost and space are remarkably reduced as compared with the conventional device incorporating three solenoid valves. The device of the invention therefore contributes to the reduction of the size of the washing machine as a whole. In addition, since the fabric conditioner container is disposed within the detergent container, the overflow of the water out of the device is prevented even when the fabric conditioner container is supplied with an excess amount of water, so that the troubles of the electric system attributable to the flooding is fairly avoided.

What we claim is:

1. A detergent supplying device of a washing machine comprising:

a detergent container containing a detergent;

a fabric conditioner container disposed in said detergent container and containing a fabric conditioner;

a first water passage having a first inlet and a first outlet, said first inlet being connected to a first water supplying valve, while said first outlet being connected to said detergent container;

a second water passage having a second inlet and a second outlet, said second inlet being connected to a second water supplying valve, while said second outlet being connected to a discharging passage, said second water passage crossing said first water passage;

a water conduit having an intake port and a third outlet, said intake port being disposed in a crossing passage where said first and second water passages cross each other, while said third outlet being connected to said fabric conditioner container, said intake port being adapted not to take the water into said water conduit when the water is supplied through either one of said first and second passages but to take the water into said water conduit when the water is supplied simultaneously through both of said first and second water passages, the water taken into said water conduit being supplied to said fabric conditioner container;

a siphon device disposed in said fabric conditioner container and adapted to discharge the water into said discharging passage when the water level in said fabric conditioner container has come to exceed a predetermined level;

a third water passage connected between said detergent container and said discharging passage; and a fourth water passage adapted to introduce the water discharged into said discharging passage to a washing basin.

2. A detergent supplying device of a washing machine comprising:

a detergent container containing a detergent;

a fabric conditioner container disposed in said detergent container and containing a fabric conditioner;

a crossing passage at which two water passages cross each other substantially at a right angle to form a common passage, said crossing passage having a first inlet, a second inlet, a first outlet opposed by said first inlet across said common passage and a second outlet opposed by said second inlet across said common passage;

a first water supplying valve connected to said first inlet;

a second water supplying valve connected to said second inlet;

a water conduit having an intake port and a third outlet, said intake port being disposed on a line which passes the point at which said two water passages constituting said crossing passage cross each other, a point between said first and second inlets and a point between said first second outlets, said intake port being opposed by said first and second inlets across said common passage, while said third outlet being connected to said fabric conditioner container;

a first water passage connected between said first outlet and said detergent container;

a second water passage connected between said second outlet and said discharging passage;

a siphon device disposed in said fabric conditioner container and adapted to discharge said water from said fabric conditioner container when the water level in the latter has come to exceed a predetermined level; and a water passage connected between said detergent container and said discharging passage.

3. A detergent supplying device of a washing machine as claimed in claim 1, wherein said siphon device includes an inner siphon pipe extending upwardly from the bottom of said fabric conditioner container and having an inlet and an outlet, and an outer siphon pipe surrounding said inner siphon pipe to form therebetween a space and having an opening in the vicinity of said bottom of said fabric conditioner container.

4. A detergent supplying device of a washing machine comprising:

a detergent container containing a detergent;

a fabric conditioner container disposed in said detergent container and containing a fabric conditioner;

a discharging passage connected to said detergent container;

a first water passage connected to a first water supplying valve and adapted to introduce the water supplied through said first water supplying valve into said detergent container;

a second water passage connected to a second water supplying valve and crossing said first water passage, and adapted to introduce the water supplied through said second water supplying valve into said discharging passage;

a water conduit having an intake port and a first outlet, said intake port being disposed in a crossing passage where said first and second water passages cross each other, while said first outlet being connected to said fabric conditioner container, said intake port being adapted not to take the water into said water conduit when the water is supplied through either one of said first and second water passages but to take the water into said water conduit when the water is supplied simultaneously through both of said first and second water passages, the water taken into said water conduit being supplied to said fabric conditioner container;

an inner siphon pipe having an inlet and a second outlet, said inlet being extended upright from the bottom of said fabric conditioner container to an upper portion of the space inside of said fabric conditioner container, while said second outlet being connected to said discharging passage;

an outer siphon pipe surrounding said inner siphon pipe with a space left therebetween and having an opening formed in the vicinity of said bottom of said fabric conditioner container.

5. A detergent supplying device of a washing machine as claimed in claim 4, wherein an outlet is formed at a portion of the side wall of said fabric conditioner container, while said outer siphon pipe is disposed around said water conduit with a space left therebetween, whereby said inner siphon pipe is constituted by said water conduit.

* * * * *